US005252047A

United States Patent [19]

Joy

[11] Patent Number: 5,252,047

[45] Date of Patent: Oct. 12, 1993

[54] GEAR PUMP WITH CONTROLLED CLAMPING FORCE

[75] Inventor: Theodore J. Joy, Mishawaka, Ind.

[73] Assignee: Allied-Signal, Inc., Morristown, N.J.

[21] Appl. No.: 33,708

[22] Filed: Mar. 16, 1993

Related U.S. Application Data

[63] Continuation-in-part of Ser. No. 946,264, Sep. 16, 1992, abandoned.

[51] Int. Cl.[5] ..... F04C 2/18

[52] U.S. Cl. ..... 418/132

[58] Field of Search ..... 418/131, 132, 102, 189

[56] References Cited

U.S. PATENT DOCUMENTS 3,021,791 2/1962 Rockwell ..... 418/189 X
3,073,251 1/1963 Weigert ..... 418/132
3,895,890 7/1975 Laumont ..... 418/132
4,239,468 12/1980 Smith ..... 418/132
5,076,770 12/1991 Dabling et al. ..... 418/102

*Primary Examiner*—Richard E. Gluck
*Attorney, Agent, or Firm*—Leo H. McCormick, Jr.; Larry J. Falguta; Robert A. Walsh

[57] ABSTRACT

A pump having a pair of intermeshing gear members retained in first and second bushings located in a cavity for pressuring a fluid from an entrance pressure to a desired exit pressure. The first bushing has a passage located therein which communicates a selected pressure less than the exit pressure which acts on an outer face of the first bushing to develop a clamping force which urges an inner face on the first bushing into engagement with the intermeshing gear members and the intermeshing gear member into engagement with an inner face on said second bushing to seal the entrance chamber from the exit chamber.

4 Claims, 1 Drawing Sheet

Discharge
Pressure
Inlet
Rotation From Inlet
30°
60°
90°
180°
270°
360°

GEAR PUMP WITH CONTROLLED CLAMPING FORCE

This is a continuation-in-part of abandoned application Ser. No. 07/946,264 filed Sept. 16, 1992.

This invention relates to a gear pump having a floating bushing which is urged into engagement with a pair of intermeshing gear members by a clamping force developed by a selected fluid pressure to control the wear, temperature and frictional resistance resulting from the engagement during the pressurizing of a fluid received by an entrance chamber and discharged from an exit chamber.

In a gear pump it is known to have a pair of meshed straight-cut spur gears are located in a cavity of a housing to define an entrance chamber and an exit chamber. One of the meshed gears is driven or rotated by an external power source, while the other gear is journaled in the housing as an idler and rotates because of its meshing engagement with the externally driven gear. The entrance chamber is connected to a source of fluid through an inlet port and as the meshed gears rotate in opposite directions successive gear pockets trap a volume of fluid which is carried by the gears from the entrance chamber to the exit chamber resulting in an increase in the fluid pressure of the fluid present in the exit chamber. The fluid in the exit chamber is discharged as pressurized fluid through an outlet port. Close tolerances, various seal and the mesh of the gears prevents the commingling of fluid between the entrance chamber and the exit chamber. Unfortunately, during the operation of such gear pumps in environmental condition below freezing the drag torque can reduce the operation efficiency.

U.S. Pat. No. 5,076,770 discloses a floating and stationary bearing structure for a gear pump which seals the entrance chamber from the exit chamber and to substantially eliminates the drag torque experienced by the intermeshing gears. In this structure, pressurized fluid from the exit chamber acts on the bearing member to provide a clamping force to seal the enhance chamber from the exit chamber. This structure performs in a satisfactory manner for most applications and yet the wear experienced by the bearings and the loss of efficiency resulting from the clamping force may be unacceptable for some applications.

In the present invention, an intermediate fluid pressure from which a clamping force is derived is selected in such a manner as to essentially balance the separation forces produced by the intermeshing gears and still seal the entrance chamber from the exit chamber. In the present invention, a pair of intermeshing gear members are retained between a floating bushing and a fixed bushing in a cavity. The gear members are rotated by an input torque applied to a shaft of one of the gears which extends through the housing. Rotation of the shaft causes fluid located in the entrance chamber to be picked up and the pressure therein to be sequentially increased on presentation to the exit chamber. The floating bearing has a passage therein through which the selected intermediate pressure is communicated to act on a first outer face of the floating bushing. The intermediate pressure acts on the first outer face to develop a force for urging a first inner face on the floating bushing into engagement with the intermeshing gear members and the intermeshing gear members into engagement with a second inner face on the fixed bushing.

The force developed by the intermediate pressure is sufficient to seal the entrance chamber from the exit chamber. A seal located on the peripheral surface of the floating bushing for prevents commingling of the fluid present in the exit chamber with fluid in the entrance chamber. Fluid trapped by the intermesh of the gears during rotation is communicated through first bores in the fixed and floating bushings and first passageways to the entrance chamber and through second bores in fixed and floating bushings and second passageways to the exit chamber to cool and lubricate the intermeshing gears. The selected intermediate pressure is critical in establishing and maintaining the clamping force to utilize the maximum efficiency of the gear pump.

Advantages such as reduced friction, wear and a balance of internal forces resulting from the use to the structure of this invention should be apparent from reading this specification while viewing the drawings wherein.

Figures 1, 2, 3, 4, 5:
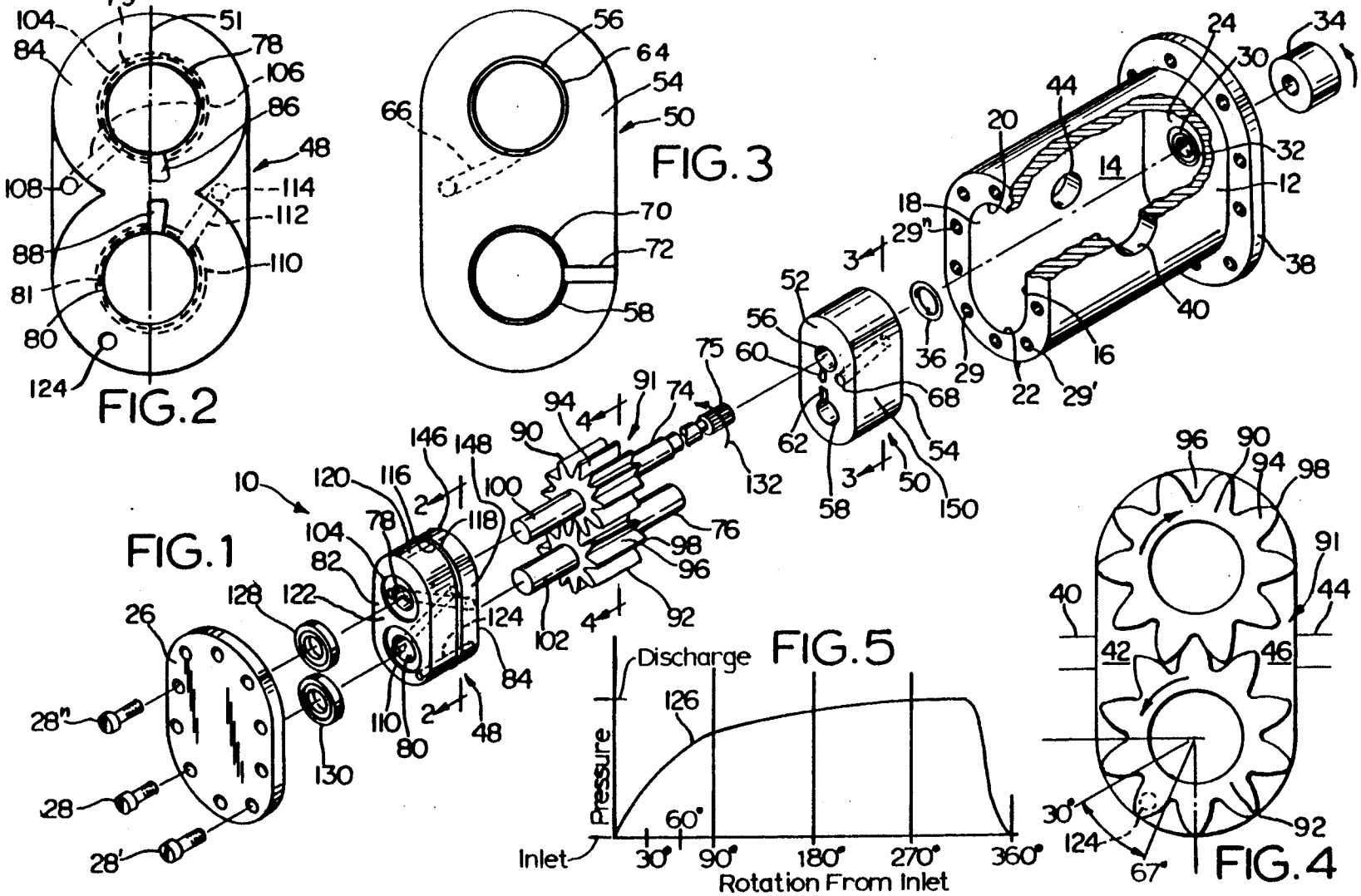
FIG. 1 is an exploded isometric view of a gear pump having a floating bearing and a fixed bearing made according to the principals of this invention.
FIG. 2 is a view taken along line 2—2 of FIG. 1.
FIG. 3 is a view taken along line 3—3 of FIG. 1.
FIG. 4 is a view taken along line 4—4 of FIG. 1 illustrating the relationship of the intermeshing gears positioned within the housing of FIG. 1.
FIG. 5 is a graph showing the sequential development of pressure in fluid for a revolution of the intermeshing gear as the fluid is communicated from the entrance chamber to the exit chamber.

The gear pump 10 shown in FIG. 1 has a housing 12 with a cavity 14 located therein. Cavity 14 has a generally oval shape with tangential side portions 16 and 18 joined by semi-circular portions 20 and 22. An integral end wall 24 closes one end while fasteners 28, 28'... 28$^n$ extend through plate 26 and engage corresponding threaded openings 29, 29'... 29$^n$ in housing 12 to close the other end of cavity 14 and form a sealed housing. End wall 24 has an axially extending stepped groove 30 which surrounds bore 32 on the cylindrical axis of semicircular portion 20. A sealing member 34 is located around bore 32 on the external surface of housing 12 while a resilient O-ring 36 is located in groove 30 on the inside to seal cavity 14 from the environment. Housing 12 has a flange 38 which is connected to a gear box for providing an input torque to rotate the intermeshing gears 91. Housing 12 has an inlet port 40 located approximately in the midpoint of side wall 16 and an outlet port 44 located approximately at the midpoint of side wall 18. Inlet port 40 is connected to a source of fluid which may be pressurized to an initial pressure level while outlet port 44 communicates pressurized fluid from exit chamber 46 through outlet port 44. The intermesh gears 91 engage the housing 12 to define an entrance chamber 42 adjacent the entrance port 40 and an exit chamber 46 adjacent the outlet port 44 as illustrated in FIG. 4.

A pair of carbon graphite bushings 48 and 50 located in cavity 14 have a geometrical shape which complements the general oval shape of cavity 14 and yet sufficient clearance is provided to allow relative movement between each bushing and housing 12 over a desired operational temperature range even with different coefficient of expansion. Thus bushings 48 and 50 can move axially and radially with respect to the cylindrical axes of surfaces 20 and 22 in cavity 14.

Bushing 50 which is located in cavity 14 adjacent end wall 24 has a first bore 56 and second bore 58 which extend therethrough from an inner face 52 to an outer face 54 along the centerlines of the cylindrical axes of surfaces 20 and 22, respectively. A first recess 60 and a second recess 62 located on inner face 52 of bushing 50 form a flow path for communicating a portion of an intermesh volume of fluid trapped by rotation of the intermeshing gears 91 to bores 56 and 58 to cool and lubricate shafts located therein. Bushing 50 has a first counter bore or chamfer 64 located on the outer face 54 and concentric to the first bore 56 for communicating the first bore 54 with a first passageway 66 connected to entrance chamber 42 by opening 68 for returning that portion of the intermesh volume of cooling fluid supplied to bore 56 to the entrance chamber 42 where it is added to the supply fluid. Bushing 50 has a second counter bore or chamfer 70 located on outer face 54 and concentric to the second bore 58 with a second passageway or slot 72 for connecting the second counter bore or chamfer 70 with exit chamber 46 to communicate that portion of the intermesh volume of cooling fluid supplied to bore 58 to exit chamber 40 where it is added to the discharge fluid in exit chamber 40.

Bushing 50 is located on shafts 74 and 76 of the intermeshing gears 91 and thereafter inserted into cavity 14. The intermeshing gears 91 include a pair of meshed straight-cut spur gear members 90, 92. Each spur gear member 90, 92 has a plurality of teeth with inter tooth spaces 96 therebetween. The outer diameter of the spur gear members 90, 92 as determined at addendum circle tip 98 of teeth 94 is substantially the same as the cylindrical diameter of surfaces 20 and 22 of housing 12. Spur gear 90 in addition to axially extending shaft 74 has a second axially extending shaft 100 while spur gear 92 in addition to axially extending shaft 76 has a second axially extending shaft 102. Shaft 74 is journaled in bore 56 and shaft 76 is journaled in bore 58 of bushing 50 while shaft 100 is journaled in bore 78 and shaft 102 is journaled in bore 80 of bushing 48 to position gears 90 and 92 in cavity 14.

Bushing 48 as seen in conjunction with FIG. 2 has a first bore 78 and a second bore 80 which extend from outer face 82 to an inner face 84. A first recess 86 located on the inner face 84 communicates a portion of an intermesh volume of fluid trapped by the rotation of intermeshing gears 91 to bore 78 to cool and lubricate shaft 100 while a second recess 88 located on inner face 84 communicates a portion of the intermesh volume of fluid to bore 80 to cool and lubricate shaft 102. A first counter bore 104 located on the outer face 82 and concentric to the first bore 78 has a first chamfer 79 which is connected to a first passageway 106 which is connected to entrance chamber 42 by opening 108 for communicating that portion of the cooling fluid of the intermesh volume to the entrance chamber 42 where it is added to the fluid in entrance chamber 42. A second counter bore 110 located on outer face 82 and concentric to bore 80 has a second chamfer 81 which is connected by a second passageway 112 which is connected to exit chamber 40 by opening 114 for communicating that portion of the cooling fluid of the intermesh volume to the exit chamber 40 where it is added to the pressurized fluid in the exit chamber 40. Bushing 48 has a groove 116 located on its peripheral surface 120 for retaining an O-ring 118. O-ring 118 is designed to engage the surface of cavity 14 and prevent fluid communication along the peripheral surface 120 from a reference chamber 122 formed in cavity 14 adjacent face 82 with end plate 26 and housing 12. Reference chamber 122 is connected by a passage 124 to receive fluid pressure at an intermediate fluid pressure level from cavity 14 at point somewhere between 30 and 67 degrees in accordance with the output schedule 126 shown in FIG. 5 for gear pump 10. A first seal 128 located in counter bore 104 and surrounding shaft 100 assures that the fluid at intermediate fluid pressure and the intermesh volume fluid pressure in bore 78 are separated from each other while seal 130 located in counter bore 110 performs a similar function with respect to shaft 102 and bore 80. After seals 128 and 130 are placed in counter bores 104 and 110, end plate 26 is attached to housing 12 to complete the assembly of gear pump 10.

In operation, when an input torque 132 is applied to spline 75 on shaft 74 gear member 90 rotates and gear member 92 follows because of the mesh of these gears. Liquid presented to entrance chamber 42 through inlet port 40 is picked up and carried in the gear packets or inter-tooth spaces 96 circumferentially around gear members 90, 92 to exit chamber 46. The change in fluid pressure of the fluid in traveling from the entrance chamber 42 to the exit chamber 46 is illustrated by curve 126 in FIG. 5. Fluid communication from the exit chamber 46 toward the entrance chamber 42 is substantially prevented by the intermeshing of the teeth 94, except that as is well known in the art, an intermesh volume of liquid which is trapped between the gear members 90, 92 at the teeth thereof approach full intermesh at line 51 as best illustrated in FIG. 2 continues to be pressurized to an operational pressure greater than the fluid pressure in exit chamber 46. In order to relieve this trapped liquid volume, recesses 60 and 62 in bushing 50 and recesses 86 and 88 in bushing 48 communicate the intermesh volume radially to bores 56, 58 and 78, 80, respectively, to cool and lubricate the shafts of the intermesh gears 91. It should be noted that in addition to cooling the flow of intermesh fluid from recesses 60 to entrance chamber 42 via bore or chamfer 56, counter bore 64, and passageway 66 and opening 68 and from recess 86 to entrance chamber 42 via bore 78, chamfer 79 in counter bore 104, passageway 106 and spending 108 and the flow of intermesh fluid from recess 62 to exit chamber 46 via bore 58 counter bore chamfer 70 and passageway or slot 72 and from recess 88 to exit chamber 46 via bore 80, chamfer 81 in counter bore 110, passageway 112 and opening 114 provides a balancing function on bearings 50 and 48.

The communication of the intermediate level fluid pressure through passage 124 to reference chamber 122 acts on face 82 and moves the inner face 84 into engagement with the intermeshing gears 91 and the intermeshing gears 91 into engagement with inner face 52 on bushing 50 to defining a clamping force which prevents commingling of fluid between the exit chamber 46 and entrance chamber 42. The fluid pressure in exit chamber 46 acts on the external surface of bushing 50, approximately one half of the surface area of the intermeshing gears 91 and front portion 146 of bushing 48 to urge surface area 148 on bushing 48 and surface area 150 on bushing 50 into engagement with sidewall 16 to seal entrance chamber 42 from exit chamber 46. O-ring 118 engages the housing to further prevent communication between the reference chamber 122 and the entrance and exit chambers 42, 46 respectively. Thus, by selectively choosing the location of passage 124 in bushing 48, the clamping force derived from the intermediate fluid pressure and consequently the internal loss of energy resulting therefrom can effectively be controlled.

I claim:

1. In a pump having a pair of intermeshing gear members retained by first and second bushings in a cavity, said gear members being rotated by an input torque to sequentially increase the entrance pressure of a fluid received by an entrance chamber through an inlet port to an exit pressure when discharged from an exit chamber to an outlet port to an operational pressure, the improvement comprising:

a first bore extending from a first face to a second face in said first bushing, said first bore retaining a first end of a first shaft associated with said intermeshing gear members;

a second bore extending from said first face to said second face of said first bushing, said second bore retaining a first end of a second shaft associated with said intermeshing gear members;

a first recess located on said second face of said first bushing for receiving a first portion of an intermesh volume of fluid trapped by said intermeshing gears during rotation, said intermesh volume of fluid being at said operational pressure, said first recess communicating said first portion of said intermesh volume of fluid to said first bore for cooling and lubricating said first end of said first shaft;

a first chamfer located on said first face and concentric to said first bore;

a first passageway in said first bushing for connecting said first chamfer to said entrance chamber where said first portion of said intermesh volume of fluid is added to said fluid in said entrance chamber;

a second recess located on said second face of said first bushing for communicating a second portion of said trapped intermesh volume of fluid at said operational pressure to said second bore for cooling and lubricating said first end of said second shaft;

a second chamfer located on said first face and concentric to said second bore;

a second passageway in said first bushing for connecting said second chamfer with said exit chamber where said second portion of said intermesh volume of fluid is added to said fluid in said exit chamber;

passage means in said first bushing through which fluid at a selected fluid pressure less than said exit fluid pressure but greater than said entrance fluid pressure is communicated to act on an outer face to develop a force for urging a first inner face into engagement with the intermeshing gear members and the intermeshing gear members into engagement with a second inner face on said second bushing to seal said entrance chamber from said exit chamber; and a peripheral surface having a seal located therein for preventing commingling of fluid at said exit fluid pressure with fluid at said selected fluid pressure.

2. In the pump as recited in claim 1 wherein said second bushing includes:

a first bore extending from said second inner face to a second outer face for retaining a second end of said first shaft associated with said intermeshing gear members;

a second bore extending from said second inner face to said second outer face for retaining a second end of said second shaft associated with said intermeshing gear members;

a first recess located on said second inner face for communicating a third portion of said intermesh volume of fluid trapped by said intermeshing gears during rotation to develop said operational fluid pressure to said first bore for cooling and lubricating said second end of said first shaft; and a second recess located on said second inner face for communicating a fourth portion of said trapped intermesh volume of fluid under said operational fluid pressure to said second bore for cooling and lubricating said second end of said second shaft.

3. In the pump recited in claim 2 wherein said second bushing further includes:

a first chamfer located on said second outer face and concentric to said first bore therein;

a first passageway connecting said first chamfer with said entrance chamber where said third portion of said intermesh volume of fluid is added to said fluid in said entrance chamber;

a second chamfer located on said second outer face and concentric to said second bore; and a second passageway connecting said second chamfer with said exit chamber where said fourth portion of said intermesh volume of fluid is added to said fluid in said exit chamber.

4. In the pump recited in claim 1 wherein the location of said passage means is selected such that said selected pressure provides a clamping force on said first outer face of approximately one half of said exit pressure.

* * * * *